US005368108A

United States Patent [19]

Aldred et al.

[11] Patent Number: 5,368,108

[45] Date of Patent: Nov. 29, 1994

[54] OPTIMIZED DRILLING WITH POSITIVE DISPLACEMENT DRILLING MOTORS

[75] Inventors: Walter D. Aldred, Port Harcourt, Nigeria; Dominic P. J. McCann, Sugar Land; John C. Rasmus, Richmond, both of Tex.

[73] Assignee: Schlumberger Technology Corporation, Houston, Tex.

[21] Appl. No.: 142,734

[22] Filed: Oct. 26, 1993

[51] Int. Cl.[5] ..... E21B 44/00

[52] U.S. Cl. ..... 175/40; 175/50

[58] Field of Search ..... 175/39–40, 175/50; 73/151

[56] References Cited

U.S. PATENT DOCUMENTS

| | | | |
|---|---|---|---|
| 4,100,528 | 7/1978 | Bernard et al. . | |
| 4,103,281 | 7/1978 | Strom et al. . | |
| 4,167,000 | 9/1979 | Bernard et al. . | |
| 4,359,898 | 11/1982 | Tanguy et al. . | |
| 4,608,861 | 9/1986 | Wachtler et al. | 175/40 X |
| 4,685,329 | 8/1987 | Burgess . | |
| 4,805,449 | 2/1989 | Das . | |
| 4,821,563 | 4/1989 | Maron | 175/40 X |
| 4,843,875 | 7/1989 | Kerbart | 175/40 X |
| 4,852,399 | 8/1989 | Falconer | 175/50 X |
| 4,981,036 | 1/1991 | Curry et al. . | |
| 5,216,917 | 6/1993 | Detournay | 175/50 X |

OTHER PUBLICATIONS

I. G. Falconer et al., "Separating Bit and Lithology Effects from Drilling Mechanics Data", IADC/SPE Conference Paper 17191, Dallas, Texas, Feb. 28, 1988.

Robbins and Myers, Inc., "MOYNO Down-hole Motors" Specification Data, Dec. 15, 1990.

*Primary Examiner*—Michael Powell Buiz

*Attorney, Agent, or Firm*—David L. Moseley; Wayne I. Kanak

[57] ABSTRACT

To optimize the drilling of a borehole with a positive displacement downhole mud motor which rotates a drill bit, the hydraulic power input to the motor and the mechanical power output of the motor are calculated based upon measurements of weight-on-bit (WOB), torque, bit rotational speed and pressure drop across the motor. These input and output values are plotted versus one another to produce a characteristic curve which indicates the maximum achievable power output of the motor. The values used by the driller are compared to such maximum to enable adjustment of WOB such that drilling at maximum efficiency for a given lithology can be achieved. Other important information such as optimum standpipe pressure and operating efficiency and wear of the motor also are determined.

18 Claims, 3 Drawing Sheets

OPTIMIZED DRILLING WITH POSITIVE DISPLACEMENT DRILLING MOTORS

FIELD OF THE INVENTION

This invention relates generally to improved methods and systems for optimizing the drilling of a well with a downhole motor that turns a drill bit in response to circulation of drilling fluids through the motor, and particularly to a process for determining from downhole measurements the optimum weight-on-bit and power requirements at which a given rock formation lithology should be drilled. Such optimum values can be compared to the actual values being used by a driller, and adjustments made so that a well can be drilled with maximum rate of penetration and efficiency.

BACKGROUND OF THE INVENTION

It has been recognized that a positive displacement drilling motor, such as a Moineau-type device which has a spiral rotor that rotates within a lobed stator, has a maximum mechanical power output. When this power output is exceeded, any additional hydraulic power that is furnished to it is dissipated by deformation of the stator. Once the stator is being deformed, there is an increase in wear thereof, and the rate at which the bit penetrates the rock is reduced. Since mechanical power output is related to the amount of hydraulic power that is input to the motor, there is a need to compare such hydraulic power input with the mechanical power output so that maximum mechanical power output can be identified and tracked in real time. The measurement of variables upon which these parameters depend, such as weight-on-bit (WOB), torque, motor shaft speed and pressure drop across the motor's power section, preferably are made downhole and in a continuous manner so that they are representative of actual values. Such measurements are transmitted uphole by a measuring-while-drilling (MWD) tool for processing and display at the surface substantially in real time. Based upon such calculations and display, mechanical power output and thus the rate of penetration of the bit can be maximized while reducing wear on the stator to a minimum, in accordance with this invention.

A broader object of the present invention is to provide a new and improved process for optimizing the drilling of a well with a downhole motor.

Another object of the present invention is to provide new and improved processes for drilling a well with a downhole motor which optimize the rate of penetration of the bit while minimizing wear on the stator of the motor.

Still another object of the present invention is to provide new and improved methods and systems for comparing hydraulic power input to a drilling motor to its mechanical power output so that stator wear can be kept at a minimum while optimizing the rate of penetration of the bit through the rock.

SUMMARY OF THE INVENTION

These and other objects are attained in accordance with the concepts of the present invention through the provision of methods and apparatus for determining the maximum power output of a downhole drilling motor and the hydraulic power that is input to the motor, and plotting the respective values versus one another to obtain a characteristic power curve. Mechanical power output is proportional to downhole torque on the bit and to the rotary speed (RPM) of the bit. Torque and RPM are measured continuously downhole and transmitted to the surface in the manner specified above. The hydraulic power input to the motor is a function of pressure drop across it and the flow rate therethrough. A plot of mechanical power output with increasing hydraulic power input has a predictable shape, assuming a constant flow rate. The optimum power output occurs when the slope of this curve is no longer positive, that is, the value thereof reaches a maximum and will shortly begin to decline.

The said power curve is processed to obtain the optimum power output and thus the optimum torque value from an analysis of the measurements. The optimum power output can be compared with the theoretical value, obtained from the motor specifications, to determine the effects of wear and temperature on the motor performance. Optimum downhole weight-on-bit is computed for the optimum torque value since there is a linear relationship between downhole torque and weight-on-bit for a given lithology. Such optimum weight-on-bit is computed in real time and displayed for the driller, together with a representation of the power curves to indicate his position on such curves. Optimum rate of penetration can be determined, since rate of penetration is a linear function of the mechanical power output of the motor. The optimum mechanical power output has a corresponding hydraulic power input from which an optimum standpipe pressure can be determined. Other useful measurements concerning the drilling process can also be determined in accordance with this invention.

BRIEF DESCRIPTION OF THE DRAWINGS

The present invention has the above and additional objects, features and advantages which will become more clearly apparent in connection with the following detailed description of a preferred embodiment, taken in conjunction with the appended drawings in which.

DETAILED DESCRIPTION OF A PREFERRED EMBODIMENT

Figure 1:
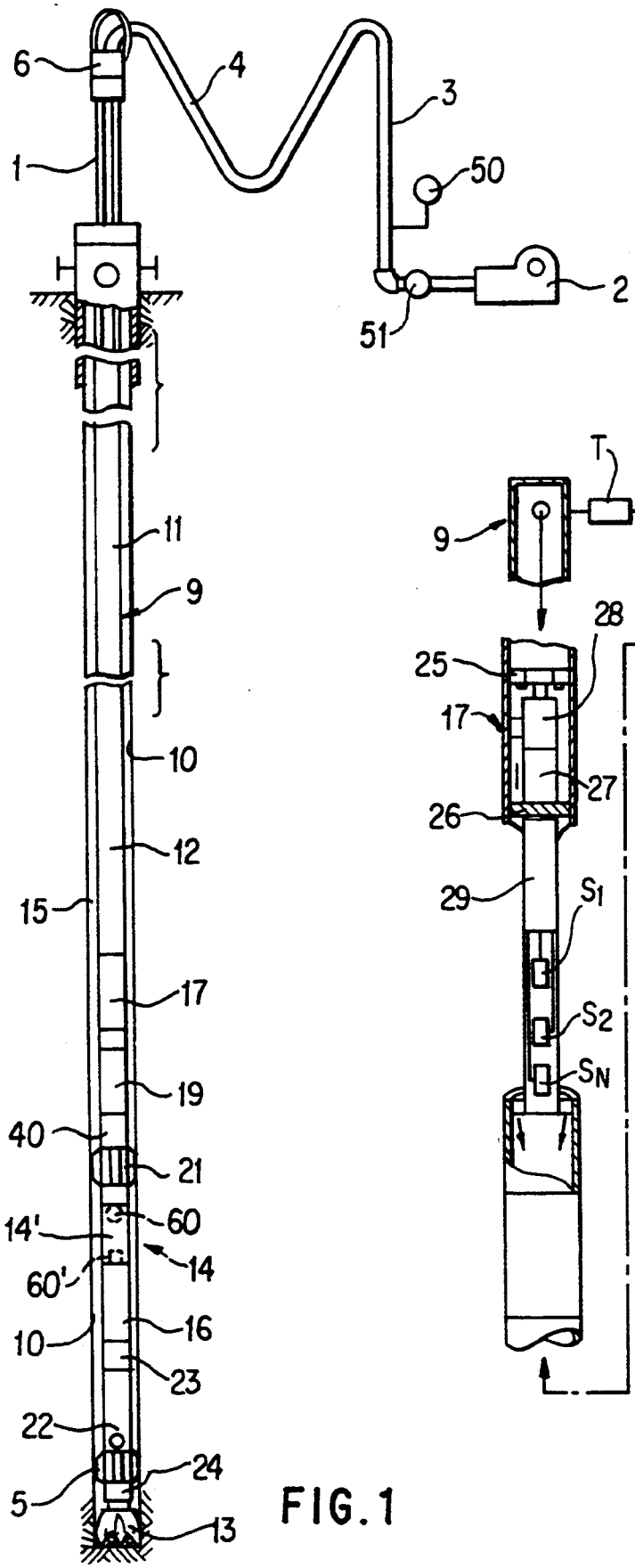
FIG. 1 is a schematic view of a well bore being drilled with a drilling motor on a drill string that includes an MWD tool therein.

Before describing the invention with respect to drawing figures, the general theory and approach of the present invention will be described. The mechanical power output of the type of motor noted above, $P_M$, can be computed as follows:

$$P_M = \pi \times T_d \times (N_M + N_S)/30 \qquad \text{(Eq. 1)}$$

Where $P_M$ is mechanical power output in watts;

$\pi$ is a constant = 3.1416 (approx.);

$T_d$ is the downhole torque in newton-meters;

$N_M$ is the rotational speed of the motor output shaft in revolutions per minute; and $N_S$ is the rotational speed of the drill string at the surface in revolutions per minute.

The hydraulic power input $P_h$ can be computed as follows:

$$P_h = \Delta P \times Q / 0.6 \quad \text{(Eq. 2)}$$

where $P_h$ is the hydraulic power input in watts;

$\Delta P$ is the pressure drop across the motor in bars; and

Q is the flow rate in liters per minute.

The pressure drop $\Delta P$ across the motor can be measured downhole with appropriate sensors in communication with the mud stream inside the tool string above and below the power section 14' of the motor (FIG. 1), or evaluated using the standpipe pressure at the surface. In this latter case, the pressure drop across the motor is given by the difference between the standpipe pressure while drilling on bottom and the standpipe pressure with the bit turning off-bottom, or under no-load conditions. Thus the pressure drop is:

$$\Delta P = P_D - P_0 + P_{LOSS} \quad \text{(Eq. 3)}$$

where $\Delta P$ is the pressure drop in bars;

$P_D$ is the standpipe pressure while drilling in bars;

$P_0$ is the standpipe pressure under no-load conditions at the same flow rate, in bars; and $P_{LOSS}$ is the differential pressure required to rotate the motor under no-load conditions, obtained from the motor specifications, in bars.

The no-load standpipe pressure $P_0$ also can be evaluated from the relationship between flow rate and standpipe pressure while the bit is off-bottom. The relationship is established either by a calibration phase in which the flow rate is systematically changed, or by automatically monitoring the standpipe pressure when the bit is off bottom, before or after the make-up of a drill pipe connection. In either case the relationship is obtained and stored in memory at the surface for various flow rates around the normal drilling value.

As noted above, the actual maximum power output of the drilling motor can be determined for a given flow rate by plotting the mechanical power output thereof versus the hydraulic power input, and displaying the resultant curve on a continuing basis on a driller's screen or display as will be described hereafter. As the downhole weight-on-bit increases the torque also increases, for a given lithology of rock, and thus the power requirements that are needed to drill also increase. At a certain level of torque, the load on the drilling motor is such that the pressure drop begins to deform the stator, and the motor works less efficiently. It will be recognized that if the torque value continues to increase, eventually the motor will stall so that the rotational speed of the motor output shaft goes to zero. In order to optimize WOB and power of the motor as drilling proceeds, various measurements are made on a continuous basis and processed so that evaluation can be made which enables a well to be drilled with optimum or near optimum efficiency.

Referring now to FIG. 1, a borehole 10 is shown being drilled by a drilling motor 14 which drives a drill bit 13. The tool string is suspended in the borehole 10 on a drill string 9 which includes drill pipe 11 and drill collars 12. The motor 14 is a positive displacement device, as previously described, which is powered by the circulation of drilling fluids (mud) down the drill string 9 by a mud pump 2 via a standpipe 3, a rotary hose 4, a swivel 6 and a kelley 1 that is connected to the top of the drill string 9. The drilling mud passes through the motor 14, out the jets of the drill bit 13, and back up to the surface via the annulus 15. The motor 14 includes a power section 14' having a helical rotor that turns within a lobed stator as drilling fluids are pumped through it. The operating principle is that of the well known Moineau pump except operated in reverse as a motor. The lower end of the rotor is connected to the upper end of a drive shaft by a cardan-type universal joint, and the lower end of the shaft is connected to the upper end of a bearing mandrel by another universal joint. The drive shaft extends down through a housing 16 which can be arranged to establish a bend angle in case directional drilling is being done. The housing 16 connects to a bearing housing 22 which includes upper and lower subs 23, 24 that carry thrust and radial bearing components to stabilize the rotation of the bearing mandrel and the bit 13 attached to the lower end thereof. The bit 13 typically has rotary cutters which chip and crash the rock as the bit is turned on bottom by the motor 14 under weight of the collars 12. Stabilizers 21 and 5, plus others uphole can be used to control the radial distance between the wall of the borehole 10 and the longitudinal axis of the drill string 9.

Figure 2:
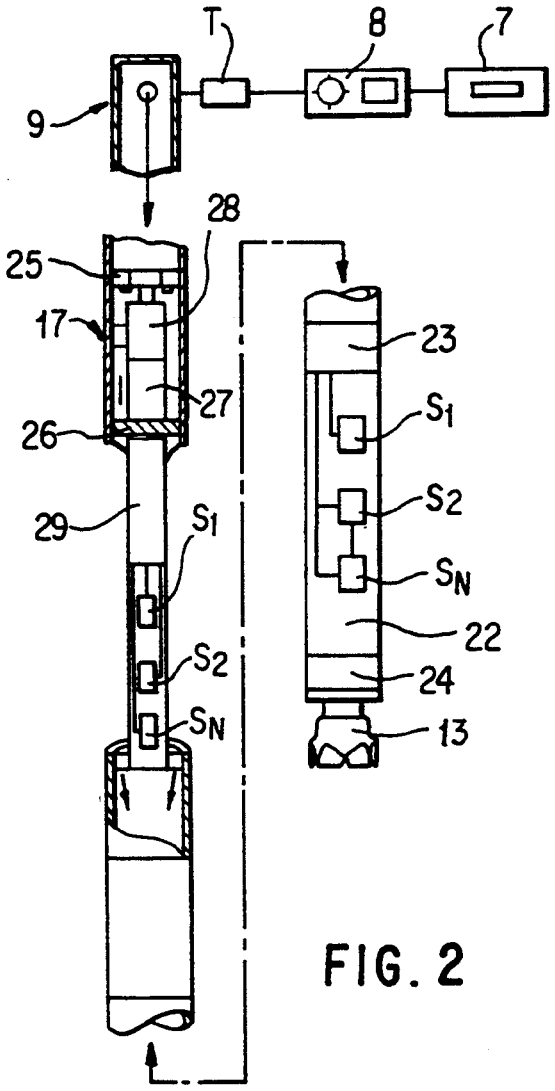
FIG. 2 is a schematic view of a combination of measuring and transmitting systems used in the tool string in FIG. 1.

Information concerning various downhole parameters and formation properties or characteristics can be telemetered to the surface through use of a measuring-while-drilling (MWD) tool 17 which is connected in the drill collar 12 above the motor 14 as shown in FIG. 1. This tool typically includes various sensors which measure hole direction parameters, certain characteristic properties of the earth formations which surround the borehole, as well as other variables. As shown in FIG. 2, drilling mud or fluids that are pumped down through the drill string 9 pass through a valve 25 which repeatedly interrupts the flow to produce a stream of pressure pulses that travel up to the surface where they are detected by a transducer T. The signals are processed and displayed at 8, and recorded at 7. After passing through the valve 25 the mud flows through a turbine 26 which drives an electrical generator 27 that provides power for the system. The operation of the valve 25 is modulated by a controller 28 in response to electrical signals from a cartridge 29 that receives measurement values from each of the various sensors $S_1, S_2 \ldots S_N$ in or on the MWD tool 17. Thus the pressure pulses which are received at the surface during a certain time period are directly related to particular measurements made downhole. See U.S. Pat. Nos. 4,100,528, 4,103,281, and 4,167,000 for further disclosures of this type of telemetry system, which is commonly referred to as a "mud siren". These patents are incorporated herein by reference.

In order to evaluate the overall efficiency of the drilling process in accordance with the invention, the values of certain parameters in addition to those noted above are measured downhole and then transmitted to the surface by the MWD tool 17 where they can be processed and displayed. These parameters include the weight on the bit 13 and the torque being applied thereto, the rotary speed of the drive shaft of the motor 14, the pressure drop across the power section 14' of the motor, and the flow rate of drilling fluids therethrough. A means 19 to measure WOB and torque downhole is disclosed in Tanguy et. al. U.S. Pat. No. 4,359,898 issued Nov. 23, 1982, which is assigned to the assignee of this invention and incorporated herein by reference. Another WOB and torque measuring sub that can be used is disclosed and claimed in application Ser. No. 08/115,285, filed Aug. 31, 1993. This application also is assigned to the assignee of this invention and is incorporated by reference herein. A means 40 to measure the rotary speed of the output shaft of the motor 14 is disclosed in application Ser. No. 07/823,789 assigned to the assignee of this invention, which also is incorporated herein by express reference.

Various known types of pressure sensors 60, 60' can be used as a means to measure pressure drop across the power section 14' of the motor 14. Such pressure sensors can include bourdon tubes, pistons, diaphragms, strain gauges and the like which respond to pressure and provide an output signal that is representative thereof. Examples include U.S. Pat. No. 4,805,449 and application Ser. No. 08/115,285, which employs pressure compensation of the weight-on-bit measurement. Another process to obtain the value of the pressure drop across the motor power section 14' is by measuring the pressure differential between the pressure in the standpipe 3 at the surface under drilling conditions and under no-load at the same flow rate. A suitable gauge 50 is provided for this measurement. Although this procedure measures downhole pressures indirectly, it is within the scope of the present invention. Flow rate can be measured by a meter 51 which is located at the surface downstream of the mud pumps 2 and before the drilling fluids enter the top of the drill string 9.

OPERATION

As noted above, studies have shown that a positive displacement motor 14 of the type described herein has a maximum mechanical power output, and that above this value, extra hydraulic power applied to the motor is dissipated by deformation of the stator. Operation beyond this peak power point accelerates wear on the stator, reduces the rate that the bit 13 penetrates the rock, and thus should be avoided. However operating at such peak value gives the maximum rate of penetration through a given rock lithology and thus optimizes the drilling of the borehole 10. In accordance with this invention the mechanical power output and the hydraulic power input are evaluated on a continuing basis so that maximum values for these parameters can be identified and tracked in real time to optimize the rate of penetration of the bit 13 through the formation and to reduce wear on the stator.

Figure 3:
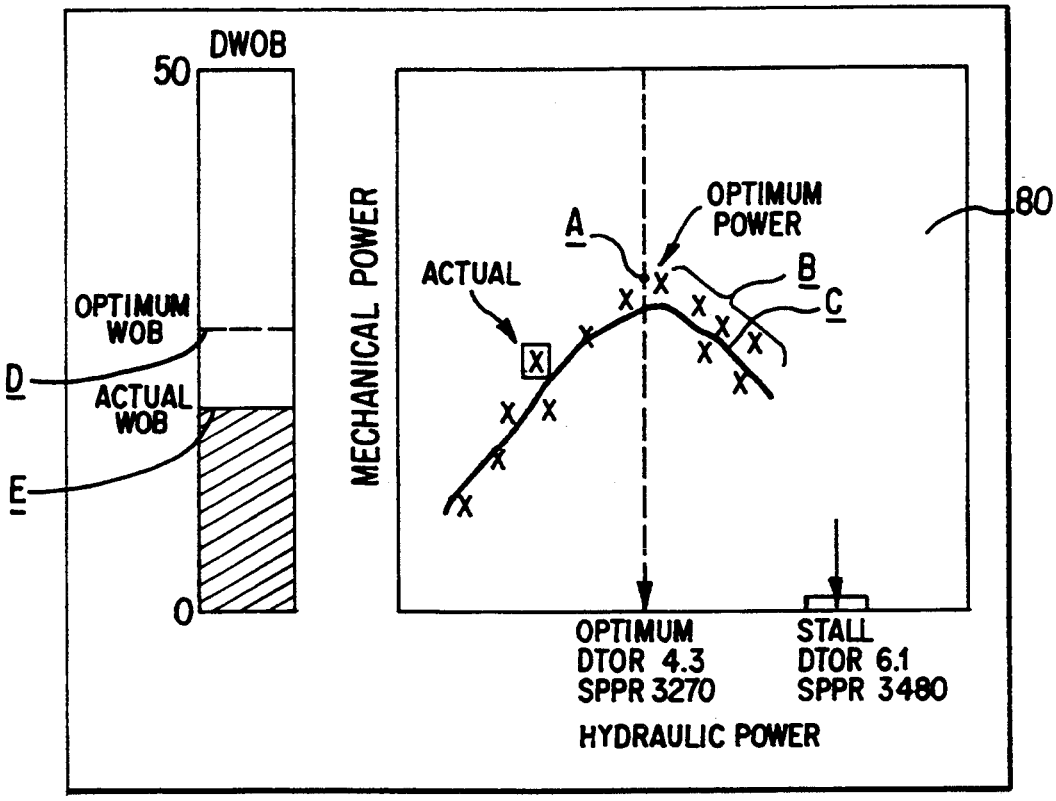
FIG. 3 is a schematic view of a driller's display or screen from which optimum values can be ascertained.

In order to provide such real-time evaluation of mechanical power output and hydraulic power input, continuous measurements are made of downhole weight-on-bit and torque by the transducer 19 as disclosed in the Tanguy U.S. Pat. No. 4,359,898 or application Ser. No. 08/115,285 noted above, and the rotary speed of the drive shaft of the motor 14 is measured by a sensor 40 of the type illustrated in application Ser. No. 07/823,789. The pressure drop across the motor 14 is measured by pressure sensors 60 and 60', or evaluated by measurements of surface standpipe pressures by the gauge 50. Flow rate of drilling fluids is measured by the meter 51 at the surface. The downhole data are transmitted to the surface by the MWD tool 17, where the data is processed at computer 8. The maximum power output of the motor 14 is determined by plotting the computed mechanical power output $P_M$ (Eq. 1) versus the hydraulic power input $P_h$ (Eq. 2), for a given flow rate. This plot is illustrated in FIG. 3, which is a schematic representation of a driller's screen 80 which is connected to the computer 8. As WOB is increased, the torque also increases for a given lithology, so that the power requirements which are needed to drill also increase. At a certain torque load on the motor 14 the pressure drop begins to deform the stator so that the motor works less efficiently. The point at which deformation dominates is shown at point A in FIG. 3, which represents a peak in the curve. After its peak value, the mechanical output power of the motor 14 diminishes over region B of the power curve C. Of course if torque requirements imposed on the motor 14 continue to increase, it eventually will stall so that the mechanical power output $P_M$ goes to zero as shown by the short arrow above the word "stall" in FIG. 3.

Since the driller, as a practical matter, can only control the torque T by varying the weight-on-bit, an optimum weight-on-bit is determined with this invention to guide the driller to this value. The power curve C is processed to obtain the optimum torque value. Once optimum torque $T_0$ is determined, the optimum downhole weight-on-bit $WOB_0$ required to achieve optimum torque is determined by using a running average of the WOB/Torque ratio which has been found to be a constant for a given formation as disclosed in U.S. Pat. No. 4,981,036, which is incorporated herein by reference. Thus $$WOB_0 = T_0(WOB/T)\text{average.} \qquad \text{(Eq. 4)}$$

In some cases the driller may also wish to see the optimum standpipe measure $P_{OPT}$, at the optimum torque. The optimum standpipe pressure is computed from the optimum hydraulic power input, $P_{hOPT}$, at the optimum mechanical power output so that:

$$P_{OPT} = \frac{P_{hOPT}}{Q(0.6)} + P_0 - P_{LOSS}$$

Where $P_{OPT}$ is the optimum standpipe pressure in bars;

$P_{hOPT}$ is the optimum hydraulic power input in watts;

Q is the flow rate in liters per minute;

$P_0$ is the standpipe pressure under no-load conditions in bars; and $P_{LOSS}$ is the differential pressure required to rotate the motor under no-load conditions, obtained from the motor specifications, in bars.

The value of $WOB_0$ is determined in real time and displayed to the driller as value D as shown in FIG. 3, together with a representation of actual WOB E to indicate the driller's position with respect thereto. The rate of penetration at the optimum weight-on-bit $WOB_0$ can also be determined because the rate of penetration ROP is a linear function of the mechanical power output.

Figure 4:
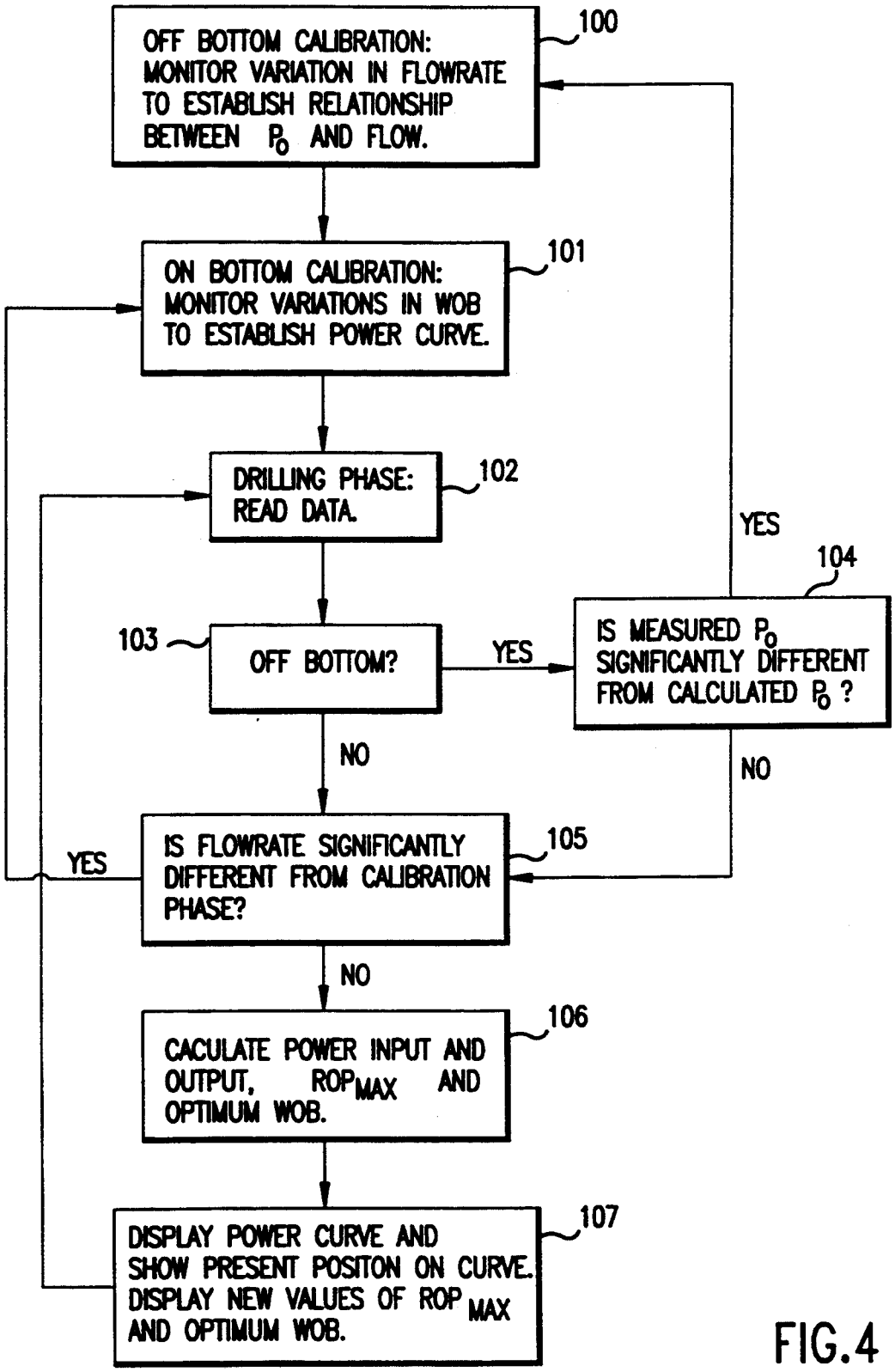
FIG. 4 is a logic diagram that further illustrates the operation of the present invention.

FIG. 4 is a flow chart or diagram representing broadly the various steps and decisions that are taken in connection with the present invention. Box 100 indicates an off-bottom calibration that is used to establish the relationship between standpipe pressure $P_0$ and flow rate Q. To accomplish this step the flow rate is varied over an operating range. It is generally accepted that there is a power law relationship between flow rate and pressure drop, i.e.

$$\log P_0 = K\log(Q) + C \qquad \text{(Eq. 5)}$$

where the constants K and C are determined from a least squares fit to the data collected during the calibration phase.

Box 101 represents on-bottom calibration where variations in WOB are monitored to establish the power curve C shown on the driller's screen 80 in FIG. 3. During this step the bit 13 is lowered onto the bottom of the hole and the WOB is gradually increased so as to increase the torque and thus develop the full power curve. Instead of this procedure, dynamometer data could be gathered at the surface to determine maximum power, however the downhole procedure is preferred because of wear and temperature effects. In Box 102 the data from all sensors discussed above are read, and in Box 103 the status of whether the bit 13 is on or off bottom is determined. If the bit is off bottom, the calibration of the off-bottom pressure is checked by comparing the measured and computed pressure values in Box 104. If these values differ significantly, say by 3 bars or more, the operator is asked for a re-calibration. If the bit 13 is on bottom, the drilling is continuing.

If the flow rate differs significantly (i.e. ±20% of mean flow rate at calibration in Box 100) from the flow rate during the calibration phase as shown in Box 105, the procedure calls for a re-calibration. If not significantly different, at Box 106 the hydraulic power input $P_h$ and mechanical power output $P_M$, maximum rate of penetration $ROP_{MAX}$ and optimum weight-on-bit $WOB_0$ are calculated as disclosed herein. Optimum torque, standpipe pressure, motor wear and motor efficiency are also calculated as disclosed herein. The value of the maximum power output corresponds to a unique combination of torque and RPM for the drilling motor 14. Thus at the maximum power output the torque is optimum. It can be shown that the ROP is linear with torque as disclosed in U.S. Pat. No. 4,685,329 which is incorporated herein by reference, thus the maximum ROP will be at the maximum mechanical power output of the motor. The relationship between torque and WOB also is linear, and thus the WOB to achieve the optimum torque can also be found for a given earth formation. At Box 107 the data are displayed to the driller at screen 80.

The ratio of the rate of penetration (ROP) to the mechanical power output has been found to be constant for a given lithology:

$$ROP/P_M = k \qquad \text{(Eq. 6)}$$

It therefore follows that at the optimum power output of the motor the ratio of the maximum rate of penetration ($ROP_{MAX}$) to the optimum mechanical power output ($P_{MO}$) will be the same as the above. Thus $$ROP_{MAX}/P_{MO} = k \qquad \text{(Eq. 7)}$$

Combining equations (1) and (6) and solving for $ROP_{MAX}$;

$$ROP_{MAX} = (ROP \times P_{MO})/P_M. \qquad \text{(Eq. 8)}$$

This value can be shown on the driller's screen 80 for comparison to the actual rate of penetration, so that adjustments can be made to drill the well at an optimum penetration rate.

The motor efficiency may be computed as the ratio of the mechanical power output to the optimum mechanical power output:

$$\text{Motor Efficiency} = \frac{P_M}{P_{MO}} \qquad \text{(Eq. 9)}$$

Motor wear may be evaluated as the ratio of the optimum mechanical power output $P_{MO}$ to the maximum mechanical power output of a new motor $P_{MN}$ at the appropriate mud flow rate:

$$\text{Motor Wear} = \frac{P_{MO}}{P_{MN}} \qquad \text{(Eq. 10)}$$

It now will be recognized that new and improved methods and systems for optimizing the drilling process where a positive displacement downhole motor is used to drill a borehole have been disclosed. Since certain changes or modifications may be made in the disclosed embodiments without departing from the inventive concepts involved, it is the aim of the appended claims to cover all such changes and modifications falling within the true spirit and scope of the present invention.

What is claimed is:

1. A method of determining the maximum power output of a downhole drilling motor for a given flow rate while drilling, said motor driving a drill bit which penetrates an earth formation, comprising the steps of: measuring the downhole torque and rotary speed of the motor; measuring the pressure drop across the motor; determining the mechanical power output of the motor as a function of torque and rotary speed; determining hydraulic power input to the motor as a function of said pressure drop and flow rate; plotting said mechanical power output versus said hydraulic power input; and determining said maximum power output from a characteristic of said plot.

2. The method of claim 1 including the further step of increasing the weight on the bit to increase said downhole torque until a point on the plot is reached where the mechanical power output begins to decrease, said point being said characteristic that defines the maximum power output for said given flow rate.

3. The method of claim 2 wherein said pressure drop across the motor is measured downhole.

4. The method of claim 2 wherein said pressure drop is measured using the difference between the standpipe pressure at the surface during drilling and the standpipe pressure with no load on the motor at the same mud flow rate.

5. The method of claim 1 including the further steps of determining the rate of penetration of said bit through the earth formation from the maximum power output; comparing said rate of penetration with the actual rate of penetration as observed at the surface; and changing the actual rate of penetration to said determined value thereof.

6. A method of drilling a well bore with a downhole motor and providing an indication of the present position of the mechanical power output of said motor with respect to an optimum value, said motor driving a drill bit which penetrates an earth formation, comprising the steps of: making continuous measurements of downhole torque, downhole weight-on-bit, rotary speed of the drilling motor output shaft, and pressure drop across said motor; telemetering said measurements to the surface substantially in real time; providing and displaying a power curve which shows an optimum value of the mechanical power output of said motor; and processing said measurements to give an indication of the actual value of said power output with respect to said optimum value.

7. The method of claim 6 including the step of varying said weight-on-bit to change said torque and thereby attain an optimum weight-on-bit for use in drilling said earth formation.

8. The method of claim 7 wherein said pressure drop across the motor is determined by measuring standpipe pressure at the surface as the bit is drilling on bottom with a certain flow rate through the motor; measuring pressure in said standpipe with no load on the motor and with the same flow rate; and comparing said measurements to obtain pressure drop across the motor.

9. The method of claim 6 including the additional step of determining the actual rate of penetration of the bit through the earth formation from measurements made at the surface; determining optimum rate of penetration based upon said downhole measurements; and adjusting the weight-on-bit to cause said actual rate to equal said optimum rate.

10. A method of drilling a well bore with a downhole motor that drives a drill bit and determining the optimum standpipe pressure at optimum drilling torque, comprising the steps of: determining the optimum hydraulic power input to the motor; measuring the standpipe pressure under no-load conditions on said motor; measuring the flow rate through said motor; and determining said optimum standpipe pressure from the sum of said optimum hydraulic power input divided by said flow rate and the said standpipe pressure under no-load conditions.

11. A method of drilling a well bore with a downhole motor that drives a drill bit and computing the efficiency of the motor, comprising the steps of: determining the actual mechanical power output of said motor while drilling; determining the optimum mechanical power output thereof; and calculating the efficiency of said motor from the ratio of actual mechanical power output to optimum mechanical power output.

12. A method of improving the efficiency of drilling a borehole with a positive displacement downhole motor which drives a drill bit and causes the bit to penetrate an earth formation, comprising the steps of: measuring the torque (T) generated by the motor and the rotary speed of said drill bit (N); measuring the pressure drop ($\Delta P$) across said motor during drilling and the flow rate (Q) of drilling fluids therethrough; computing the mechanical power output ($P_M$) of said motor in accordance with the relationship $P_M=\pi TN$; computing the hydraulic power input ($P_h$) to said motor in accordance with the relationship $P_h=\Delta PQ$; generating a plot of mechanical power output versus hydraulic power input while increasing the weight-on-bit (WOB) to increase the torque applied by said motor to the bit; and determining the optimum mechanical power output ($P_{MO}$) from a characteristic of said plot.

13. The method of claim 12 wherein said characteristic is the peak value of said mechanical power output.

14. The method of claim 12 including the further steps of obtaining a running average of the ratio of WOB and T; determining the optimum torque ($T_0$) at said optimum mechanical power output; and determining optimum weight-on-bit ($WOB_0$) from the relationship $WOB_0=T_0(WOB/T)$ average.

15. The method of claim 14 including the further steps of comparing: actual weight-on-bit (WOB) to optimum weight-on-bit ($WOB_0$); and adjusting said actual weight-on-bit to be substantially equal to said optimum weight-on-bit.

16. The method of claim 15 including the further step of determining the maximum rate of penetration ($ROP_{MAX}$) of the bit at said optimum weight-on-bit as a linear function of mechanical power output $P_M$.

17. The method of claim 12 including the further step of determining the efficiency of said motor by the ratio of said mechanical power output $P_M$ to said optimum mechanical power output $P_{MO}$.

18. The method of claim 12 including the further step of determining the wear of said motor by the ratio of said optimum mechanical power output $P_{MO}$ to the maximum mechanical power output of said motor when new.

* * * * *